United States Patent [19]

Mui et al.

[11] Patent Number: 4,860,179

[45] Date of Patent: Aug. 22, 1989

[54] ILLUMINATED UMBRELLA

[76] Inventors: Paul Y. H. Mui, 118 Tammy Cir., West Pittsburg, Calif. 94565; Rosa Y. M. Tso, 3218 Quintara St., San Francisco, Calif. 94116

[21] Appl. No.: 195,235

[22] Filed: May 18, 1988

[51] Int. Cl.[4] ..... A45B 3/02

[52] U.S. Cl. ..... 362/102; 362/800

[58] Field of Search ..... 362/102, 124, 800

[56] References Cited

U.S. PATENT DOCUMENTS

| | | | |
|---|---|---|---|
| 879,640 | 2/1908 | Hockenberry | 362/124 |
| 1,166,272 | 12/1915 | Smithing | 362/102 |
| 1,659,346 | 2/1928 | Beatty | 362/102 |
| 1,720,228 | 7/1929 | Malum | 362/102 |
| 2,246,836 | 6/1981 | Campbell | 362/102 |
| 2,507,919 | 5/1950 | Mazzeo | 362/102 |
| 3,226,880 | 1/1966 | Novello | 362/124 |
| 3,777,136 | 12/1973 | Okuda | 362/102 |
| 4,031,381 | 6/1977 | Carver | 362/102 |
| 4,231,079 | 10/1980 | Heminover | 362/800 |
| 4,290,095 | 9/1981 | Schmidt | 362/800 |

*Primary Examiner*—Ira S. Lazarus
*Assistant Examiner*—Sue Hagarman
*Attorney, Agent, or Firm*—Townsend and Townsend

[57] ABSTRACT

Visibility of a conventional umbrella is enhanced by including an illuminating device on the external side of the umbrella canopy and by incorporating a flashlight into the handle portion of the umbrella shaft. The flashlight is concealably pivotably mounted in a cavity in the lower end of the umbrella shaft. This allows the flashlight to be housed in the cavity when not needed, and pivoted out of the cavity so as to illuminate the user's path when needed. The illuminating device is controlled by a switch and a switching circuit in the handle region of the umbrella shaft. The illuminating device may be turned ON or OFF, or caused to blink ON and OFF automatically by means of the switch and switching circuit.

11 Claims, 2 Drawing Sheets

ILLUMINATED UMBRELLA

BACKGROUND OF THE INVENTION

1. Field of the Invention

This invention relates to umbrellas, and more specifically to an apparatus and method for enhancing the visibility of a person using an umbrella in inclement weather.

2. Background and Description of Prior Art

As is well known, umbrellas are most often used during weather conditions that impair visibility. Under such conditions, and especially at night, it is dificult for motorists and others to see the umbrella user, creating a dangerous situation for those persons using the umbrella. Reduced visibility can also make it difficult for the umbrella user to see approaching objects such as oncoming vehicles, telephone poles and other pedestrians.

Previous attempts to enhance visibility of the umbrella have involved making the umbrella canopy bright or reflective, with the intent of enabling others to better see the umbrella and, thereby, the user. Conversely, there have been attemps to improve the user's visibility by making at least a portion of the umbrella canopy transparent. Although helpful, these solutions do not adequately solve the problem.

SUMMARY OF THE INVENTION

According to the present invention, the visibility of a conventional umbrella is enhanced by providing the umbrella with one or more battery operated, light-emitting devices. Thereby, when illuminated, the light-emitting devices operate to enhance the visibility of the umbrella, and anyone using the umbrella.

In a preferred embodiment of the invention, an umbrella of conventional construction is provided with light-emitting apparatus attached to the umbrella, at locations preferred for their visibility, such as at the free ends of the canopy-supporting ribs of the umbrella rib structure. The handle or lower end of the umbrella shaft is formed to carry the source of power (e.g., batteries), the ON/OFF switch controls for the light-emitting devices, and the necessary wiring to connect the power source and switch controls to control selection of illumination and non-illumination states of the light-emitting devices.

In a preferred form of the invention, the switch controls include a slide switch positionable in multiple positions: One position provides constant illumination of the light-emitting devices; another permits the light-emitting devices to blink automatically, thus increasing both battery life and visibility enhancement. A third position terminates illumination.

In yet another form of the invention, the handle end of the umbrella shaft is configured to hold a concealable, pivotable flashlight mechanism capable of locking at various orientations. This flashlight mechanism operates from a battery supply and switch control independent of that used for the light-emitting devices. Use of the pivotable flashlight improves the umbrella user's ability to see without requiring the user to hold an external flashlight.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
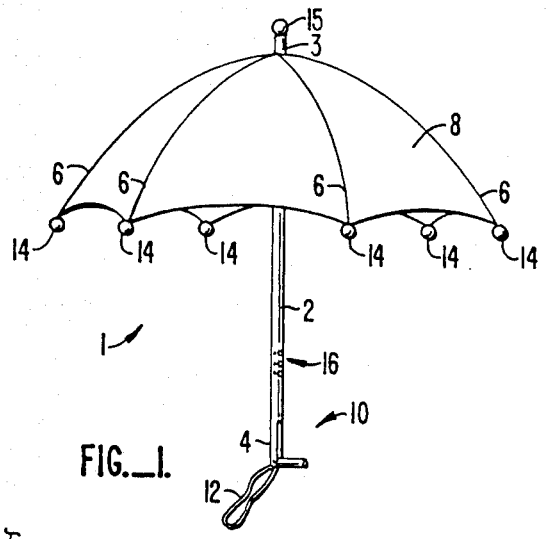
FIG. 1 is a perspective view of an umbrella constructed according to the present invention.

Turning now to the Figures, and in particular, FIG. 1, there is shown an umbrella of generally standard construction, modified to carry the illumination apparatus of the present invention, designated generally with the reference numeral 1. As illustrated, the umbrella 1 includes a shaft 2 at an upper end 3 of which are affixed, in conventional manner, a plurality of support ribs 6. A canopy 8 of known design and construction is attached or otherwise affixed to the support ribs 6. The ribs are pivotably attached to the shaft in a manner that allows them to assume a collasped position in which the ribs 6 and canopy 8 are about the shaft 2 to form a compact structure that can easily be carried, and an extended position that places the canopy 8 in the rain-protective arrangement illustrated in FIG. 1.

Mounted at the free ends of each of the ribs 6 are illuminating devices 14, which are preferably low power light-emitting bulbs of the type operable from, for example, flashlight batteries. In addition, a light-emitting device 15 may also be mounted at the terminus of the free end 3 of the shaft 2 (which, as illustrated in FIG. 1, protrudes above the open canopy 8).

Formed at a lower end 4 of the shaft 2 is a handle assembly 10 having a handle strap 12. The handle assembly 10 is constructed to carry the necessary switching, in the form of a switch control unit 16. The power source (not shown) for controlling illumination of the light-emitting devices 14 (e.g., turning them ON and OFF) is preferably contained within the handle assembly 10, and accessible by any conventional means, such as slidable or hinged plates (not shown) that open to the interior of the handle assembly.

Figure 2:
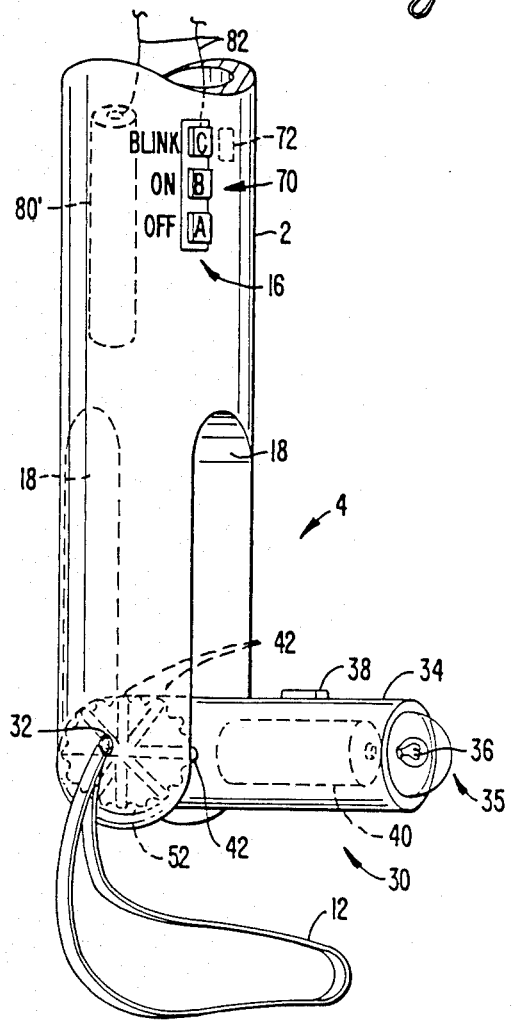
FIG. 2 is an enlarged perspective view of the handle assembly of the umbrella shown in FIG. 1, illustrating a control unit and a flashlight assembly.

Turning now to FIG. 2, the handle assembly 10 is illustrated in greater detail. As shown, the handle assembly 10 is formed to have at its terminus, a channel or cavity 18, pivotally mounted in which is a flashlight assembly 30. A pivot pin 32 penetrates the shaft lower end 4 to secure the flashlight assembly 30 in a manner that permits the flashlight assembly 30 to rotate 360° about the pivot pin 32. The flashlight assembly 30 may be placed in a stored position (FIG. 3) wherein the flashlight assembly 30 is substantially housed in the cavity 18. Alternatively, the flashlight assembly 30 may be rotated about the pivot pin 32 to a use position as shown in FIG. 2. Although FIG. 2 shows the flashlight assembly 30 rotated substantially 90° to the shaft 2, the flashlight assembly 30 may be rotated to any desired angle. The flashlight assembly 30 is conventional in construction and includes a body 34 having a light-emitting end 35, a bulb 36 located in end 35, a switch 38, and battery 40 (shown in phantom).

The flashlight assembly 30 is maintained at the desired angle of rotation by friction between the flashlight bdy 34 and the inner surface of the lower shaft end 4. To increase this friction, the surface of the flashlight body 34 includes a number of raised ribs 42 which extend radially from where the pivot shaft 32 penetrates the flashlight body 34. In a like manner, the inner surface of the lower shaft end 4 includes a number of similarly shaped channels 52 that are configured to engage and mate with the raised ribs 42. In use, frictional contact and mating engagement between these ribs 42 and channels 52 (shown in phantom), allows the flashlight assembly 30 to be rotated about the pivot shaft 32 and be maintained at any selected angle.

Figure 3:
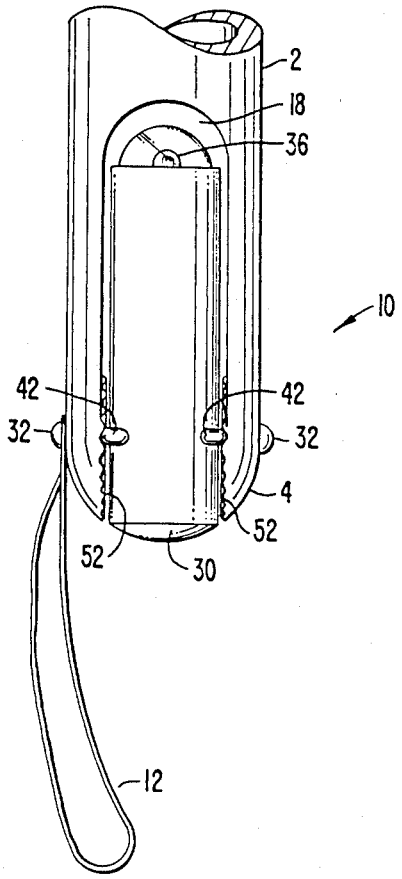
FIG. 3 is a side view of the handle assembly of FIG. 2, illustrating the flashlight assembly stowed in a cavity formed in the handle assembly.

Referring now to FIG. 3, the pivot locking mechanism of the handle assembly 10 is shown in detail in a side view. Fig. 3 shows the flashlight unit 30 rotated upward and stored inside the cavity 18 in the shaft 2. As shown, the flashlight unit 30 is maintained in this stowed position by frictional contact between the ribs 42 and channels 52.

Figure 5A:
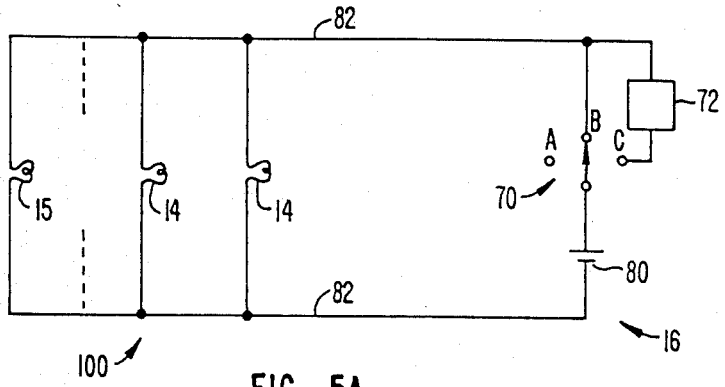
FIGS. 5A and 5B each illustrate, in block diagram form, the representative illumination circuits that can be used with the umbrella of FIG. 1.

Referring now to FIGS. 2 and 5A, control unit 16 is illustrated as including a three-position switch 70, a switching circuit 72, a battery 80 (shown in phantom) and connecting wires 82. The positions (A, B, C) of the three-position switch 70 operate (1-position A) to turn the light-emiting devices 14 OFF by opening the electrical circuit 100 between the battery 80, the wires 82 and the light-emitting devices 14; (2-position B) to establish an electrical circuit between the battery 80 and the light-emitting devices 14 for illumination; and (3-position C) to place a switching circuit 72 in the electrical circuit 100. Switching circuit 72 is a conventional circuit or component for alternately connecting and disconnecting the battery 80 to the light-emitting devices 14 to effect a blinking operation.

Figure 4:
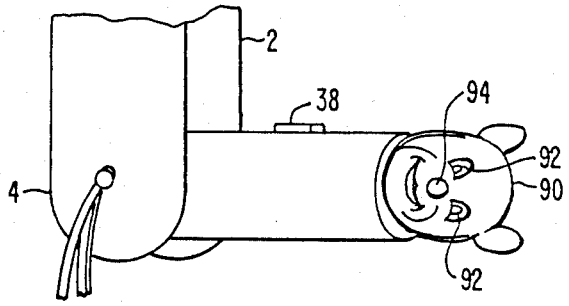
FIG. 4 is a perspective view of an alternative embodiment of the flashlight unit of FIG. 2, including a decorative illuminated character.

FIG. 4 illustrates an embodiment wherein the light-emitting end 35 of flashlight assembly 30 is in the form of a decorative character 90.

Figure 5B:
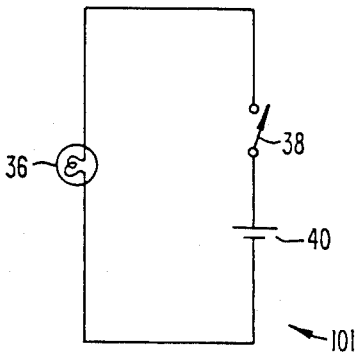

FIG. 5B is an illustrative block diagram of the circuit 101 used to illuminate the flashlight assembly 30 in the present invention.

In use, umbrella 1 is opened in the conventional manner. In the open position, canopy 8 is expanded as shown in FIG. 1, and light-emitting devices 14 are unobstructed. If the user wishes to enhance the visibility of the umbrella, the three-position switch 70 is moved from position A to position B to illuminate the light-emitting devices 14, 15. If desired, the three-position switch 70 may be placed in position C to cause devices 14 to automatically blink ON and OFF. Of course, when there is no longer any need for enhanced visibility, the three-position switch 70 can be returned to position A to turn the light-emitting devices 14 and 15 OFF.

When the user so requires the use of the flashlight assembly 30, it may be rotated out of its stored position in the cavity 18 by pushing on the flashlight body 34. The flashlight assembly 30 can then be turned ON or OFF with the switch 38 in the conventional manner. The flashlight assembly 30 is then rotated to any desired degree of rotation, and is held at that angle by friction between the ribs 42 and the channels 52. Once the flashlight assembly 30 is at the desired angle, any further aiming may be accomplished by moving umbrella shaft 2. In this manner, the umbrella user has the benefit of a flashlight that may be aimed as needed, without requiring the user to have a free hand to hold a flashlight.

Modifications and variations may be made to the disclosed embodiments without departing from the subject of the invention as defined by the following claims. For instance, while FIG. 5 shows illuminating devices 14 and 15 as low-power incadescent bulbs, they may also be light-emitting diodes, and bulb 36 as being incandescent; it will be appreciated that other device types may be used in either application. Further, although FIG. 5 shows devices 14 connected in parallel, those skilled in the art will appreciate that devices 14 could be connected in other ways, such as in series. Fewer or more illuminating devices 14 may be used at other positions on umbrella 1.

What is claimed is:

1. In an umbrella of the type having a shaft with an upper shaft end and a lower shaft end, ribs connected to said upper shaft end, and a canopy having an external side covering said ribs, a visibility enhancement system comprising:

an illuminating device mounted on the external side of said canopy;

a power source;

circuit means for coupling said illuminating device to said power source, said circuit means including means for switching said illuminating device on or off; and a flashlight pivotably and concealably mounted in said lower shaft end, for directing a light beam in a chosen direction;

said lower shaft end including a pivot pin defining a pivot axis disposed perpendicular to an axis defined by said shaft, and said lower shaft end defining a flashlight-sized cavity;

the pivot pin securing a non-illuminating end of the flashlight to the lower shaft end, enabling said flashlight to rotate 360° about the pivot axis;

means for frictionally maintaining said flashlight in any disposition of rotation, said means including a plurality of raised ribs radiating outwardly from the pivot axis, disposed on a surface of a non-illuminating end of said flashlight, and a plurality of rib-sized channels radiating outwardly from the pivot axis, disposed on an inner surface of said cavity;

said ribs and said channels frictionally engaging each other for retaining the flashlight at various dispositions of rotation;

said cavity receiving and concealing said flashlight when said flashlight is rotated into a fully concealed disposition.

2. The invention of claim 1, including circuit means for causing said illuminating device to blink on and off automatically.

3. The invention of claim 1, wherein said illuminating device includes a light-emitting diode.

4. The invention of claim 1, including means for housing said power source and said conduit means in said lower shaft end.

5. The invention of claim 1, wherein said flashlight has a light-emitting end and a decorative animal's head mounted on said light-emitting end, said head including an area through which light from said flashlight may pass.

6. In an umbrella of the type having a shaft with an upper shaft end and a lower shaft end, ribs connected to said upper shaft end, and a canopy having an external side covering said ribs, a visibility enhancement system comprising:

a light-emitting diode mounted on the external side of said canopy;

a power source;

circuit means for coupling said illuminating device to said power source, said circuit means including means for switching said illuminating device on or off;

means for causing said light-emitting diode to blink automatically on and off;

means for housing said power source and said circuit means in said lower shaft end;

a flashlight pivotably and concealably mounted in said lower shaft end, for directing a light beam in a chosen direction;

wherein said lower shaft end includes a pivot pin defining a pivot axis, disposed perpendicular to an axis defined by said shaft, and said lower shaft end defines a flashlight-sized cavity;

the pivot pin securing a non-illuminating end of the flashlight to the lower shaft end, enabling said flashlight to rotate 360° about the pivot axis;

means for frictionally maintaining said flashlight in any disposition of rotation, said means including a plurality of raised ribs radiating outwardly from the pivot axis, disposed on a surface of a non-illuminating end of said flashlight; and a plurality of rib-sized channels radiating outwardly from the pivot axis, disposed on an inner surface of said cavity;

said ribs and said channels frictionally engaging each other for retaining the flashlight at various dispositions of rotation;

said cavity receiving and concealing said flashlight when said flashlight is rotated into a fully concealed disposition.

7. The invention of claim 6, wherein said flashlight has a light-emitting end and a decorative animal's head mounted on said light-emitting end, said head including an area through which light from said flashlight may pass.

8. In an umbrella of the type having a shaft with an upper shaft end and a lower shaft end, ribs connected to said upper shaft end, and a canopy having an external side covering said ribs, a visibility enhancement system comprising:

a flashlight pivotably and concealably mounted in said lower shaft end, for directing a light beam in a chosen direction; and means for frictionally maintaining said flashlight in any disposition of rotation, said means including a plurality of raised ribs radiating outwardly from the pivot axis, disposed on a surface of a non-illuminating end of said flashlight, and a plurality of rib-sized channels radiating outwardly from the pivot axis, disposed on an inner surface of said cavity;

said ribs and said channels frictionally engaging each other for retaining the flashlight at various dispositions of rotation.

9. The invention of claim 8, further including:

an illuminating device mounted on the external side of said canopy;

a power source;

circuit means for coupling said illuminating device to said power source, said circuit means including means for switching said illuminating device on or off and means for causing said illuminating device to blink on and off automatically; and means for housing said power source, said circuit means and said means for causing in said lower shaft end.

10. The invention of claim 8, wherein said lower shaft end includes a pivot pin defining a pivot axis disposed perpendicular to an axis defined by said shaft, and said lower shaft end defines a flashlight-sized cavity;

the pivot pin securing a non-illuminating end of the flashlight to the lower shaft end, enabling said flashlight to rotate 360° about the pivot axis;

said cavity receiving and concealing said flashlight when said flashlight is rotated into a fully concealed disposition.

11. A method for enhancing the visibility of an umbrella of the type having a shaft with an upper shaft end and a lower shaft end, ribs connected to said upper shaft end, and a canopy having an external side covering said ribs, which comprises:

mounting an illuminating device on the external side of said canopy;

actuating said illuminating device;

causing said illuminating device to blink on and off automatically;

providing a flashlight having a plurality of raised ribs radiating outwardly from a pivot axis disposed on a surface of a non-illuminating end of said flashlight;

providing a cavity in said lower shaft end sized to receive said flashlight, an inner surface of said cavity including a plurality of rib-sized channels radiating outwardly from a pivot axis; said cavity including a pivot pin defining a pivot axis disposed perpendicular to an axis defined by said shaft, said pivot pin securing said non-illuminating end of said flashlight to the lower shaft end, enabling said flashlight to rotate 360° about the pivot axis;

mounting, pivotably and concealably said flashlight in said lower shaft end about said pivot axis such that said rib-sized channels frictionally engage with said raised ribs on said flashlight to retain the flashlight at various dispositions of rotation; and directing a beam of light from said flashlight in a desired direction.

* * * * *